US005685736A

United States Patent [19]

Lung

[11] Patent Number: 5,685,736

[45] Date of Patent: Nov. 11, 1997

[54] CONNECTOR JACKET

[76] Inventor: Nu Lung, P.O. Box 82-144, Taipei, Taiwan

[21] Appl. No.: 629,072

[22] Filed: Apr. 8, 1996

[51] Int. Cl.[6] ..... H01R 13/56

[52] U.S. Cl. ..... 439/447; 439/344

[58] Field of Search ..... 439/445, 447, 439/676, 344

[56] References Cited

U.S. PATENT DOCUMENTS 5,334,044 8/1994 Falossi et al. ..... 439/447
5,462,457 10/1995 Schroepfer et al. ..... 439/447
5,494,457 2/1996 Kunz ..... 439/447

*Primary Examiner*—Gary F. Paumen
*Attorney, Agent, or Firm*—Alfred Lei

[57] ABSTRACT

A connector jacket includes a bottom shell, and an upper shall having one side hinged to one side of the bottom shell. The upper shell is secured to the bottom shell in the closed position to hold a module plug on the inside by hooking respective downward hooks of the upper shell in respective retaining notches at the reduced rear end of the bottom shell and forcing respective toothed retaining rods of the bottom shell into engagement with respective retaining holes on respective retaining blocks at the reduced rear end of the upper shell.

2 Claims, 2 Drawing Sheets

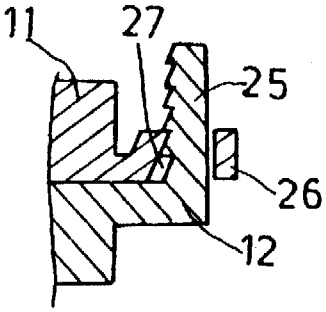
FIG. 4
FIG. 3
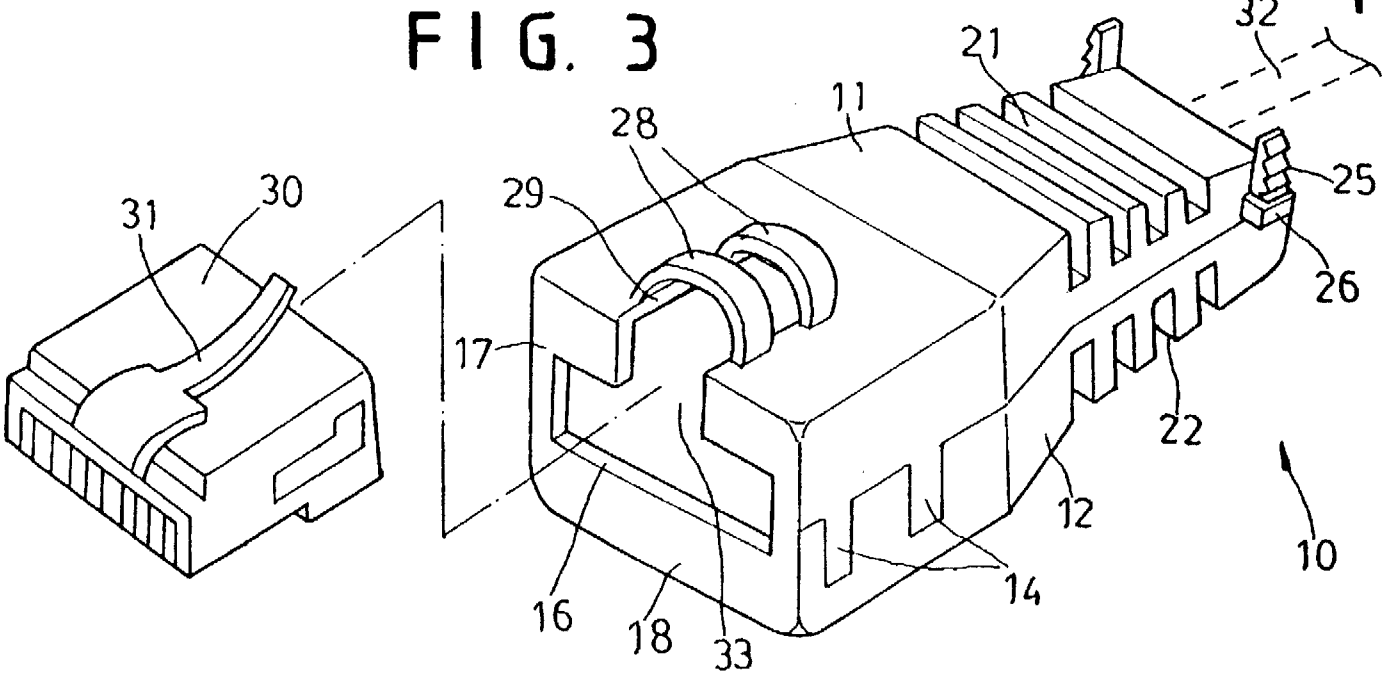
FIG. 1

CONNECTOR JACKET

BACKGROUND OF THE INVENTION

1. Field of the Invention

This invention relates to connector jackets, and relates more particularly to such a connector jacket which includes an upper shell and a bottom shell fastened together to hold a module plug on the inside.

2. Description of the Prior Art

The electric connector for a module plug of a telephone line or computer network cable is covered with a connector jacket for protection. A connector jacket for this purpose generally has a broad front opening which receives the module plug, a reduced rear end defining a wire hole for the passing of the electric wire of the module plug, and a convex portion at the top which protects the springy rod of the module plug. This structure of connector jacket must be mounted on the electric wire before the connection of the electric wire to the module plug. When the connector jacket is installed, the module plug cannot be conveniently removed from the connector jacket for inspection. There is known another structure of connector jacket which has a pair of protective plates which protect the springy rod of the module plug. This structure of connector jacket is complicated to manufacture. There is known still another structure of connector jacket which is comprised of two separated shells, namely, the upper shell and the bottom shell connected together by forcing respective retaining rods of the upper shell into engagement with respective retaining holes of the bottom shell, wherein the upper shell has two protective wings which protect the springy rod of the module plug. This structure of connector jacket cannot be conveniently opened after its installation.

SUMMARY OF THE INVENTION

This invention is concerned with a connector jacket which comprises a bottom shell, and an upper having one side hinged to one side of the bottom shell. The upper shell is secured to the bottom shell in the closed position to hold a module plug on the inside by hooking respective downward hooks of the upper shell in respective retaining notches at the reduced rear end of the bottom shell and forcing respective toothed retaining rods of the bottom shell into engagement with respective retaining holes on respective retaining blocks at the reduced rear end of the upper shell. According to another aspect of the present invention, each of the toothed retaining rods has a longitudinal series of teeth sloping in one direction, and the retaining hole of each of the retaining blocks has a sloping side engaged with the teeth of the respective toothed retaining rod to prohibit it from backward movement.

Other objects of the invention will in part be obvious and in part hereinafter pointed out.

The invention accordingly consists of features of constructions and method, combination of elements, arrangement of parts end steps of the method which will be exemplified in the constructions and method hereinafter disclosed, the scope of the application of which will be indicated in the claims following.

BRIEF DESCRIPTION OF THE DRAWINGS

FIG. 1 is an elevational view of a connector jacket according to the present invention (before the installation of the module plug);

FIG. 3 is a sectional view of a part of the connector jacket shown in FIG. 1, showing the hook of the upper shell fastened to the respective retaining notch of the bottom shell; and FIG. 4 is a sectional view of a part of the connector jacket shown in FIG. 1, showing the toothed retaining rod of the bottom shell fastened to the retaining hole of the respective retaining block of the upper shell.

DETAILED DESCRIPTION OF THE PREFERRED EMBODIMENT

Figure 2:
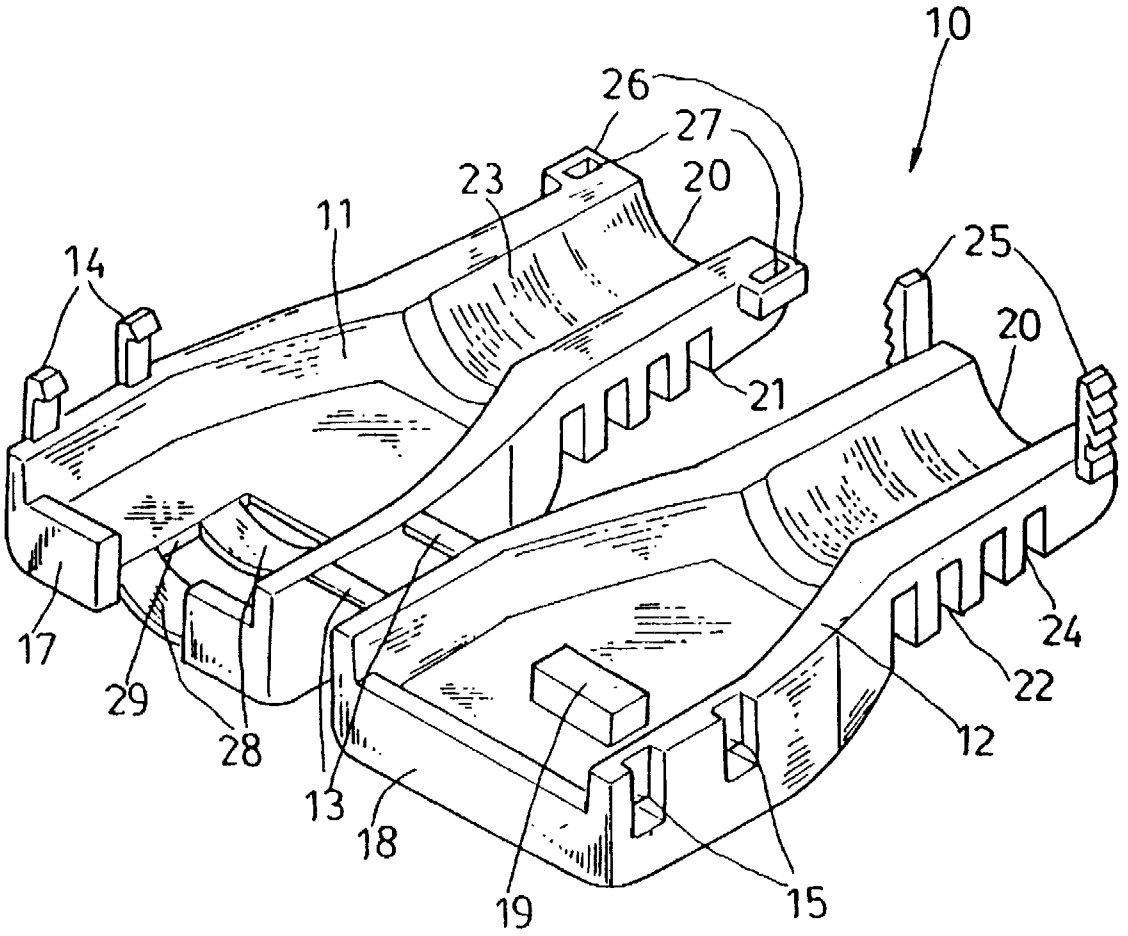
FIG. 2 is an extended out view of the connector jacket shown in FIG. 1.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIGS. from 1 to 4, the connector jacket, referenced by 10, is for the protection of a module plug 30, which comprises an upper shell 11, a bottom shell 12, and a connecting strip 13 connected between the upper shell 11 and the bottom shell 12. The upper shell 11 comprises two downward hooks 14 longitudinally spaced at one side oppose to the connecting strip 13 and near the front end respectively forced into engagement with two longitudinally spaced retaining notches 15 at one side of the bottom shell 12 (see FIG. 3). When the downward hooks 14 of the upper shell 11 are respectively 17 hooked in the retaining notches 15 of the bottom shell 12, a rectangular front opening 16 is formed within the downward front flange 17 of the upper shell 11 and the upward front flange 18 of the bottom shell and a connector chamber 33 is defined between the upper shell 11 and the bottom shell 12 behind the front opening 16 for the mounting of the module plug 30. The bottom shell 12 has a locating block 19 on the inside which stops the module plug 30 in place. The electric wire 32 of the module plug 30 extends out of a wire hole 20 at the rear end of the connector jacket 10. The upper shell 11 and the bottom shell 12 define a respective longitudinal groove 23, 24 within the respective reduced rear end for the passing the electric wire 32. Transverse grooves 21, 22 are respectively made on the reduced rear ends of the upper shell 11 and bottom shell 12 on the outside. The upper shell 11 further comprises two retaining blocks 26 bilaterally raised from the periphery of the reduced rear end and defining a respective retaining hole 27. The bottom shell 12 further comprises two toothed retaining rods 25 bilaterally raised from the periphery of the reduced rear end and respectively forced into engagement with the retaining holes 27 of the retaining blocks 26 of the upper shell 11 (see FIG. 4). The teeth of each of the toothed retaining rods 25 slope in one direction. The retaining hole 27 of each of the retaining blocks 26 is preferably having a sloping side which prohibits backward movement of the respective toothed retaining rod 25. The connection between the toothed retaining rods 25 and the retaining blocks 26 enables the upper shell 11 and the bottom shell 12 to fit the diameter of the electric wire 32. However, when the toothed retaining rods 25 are respectively bent inwards, they cam be conveniently removed out of the retaining holes 27 of the retaining blocks 26. Furthermore, the upper shell 11 has a longitudinal top opening 29 extending to the front end which receives the springy rod 31 of the module plug 30, and two arched ribs 28 bridging over the longitudinal top opening 2 which protect the springy rod 31 of the module plug 30 in the longitudinal top opening 29.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A connector jacket comprising a bottom shell, an upper shell covered on said bottom shell to hold a module plug having a spring rod therein, and a connecting strip connected between one side of said upper shell and one side of said bottom shell, wherein said bottom shell comprises a front opening at a front end thereof which receives said module plug, a locating block on a side of said bottom shell which holds said module plug in place, two retaining notches on the outside of said bottom shell opposite to said connecting strip, a longitudinal wire groove defined within a reduced rear end of said bottom shell and terminating in a rear opening for the passing of the electric wire of said module plug, and two toothed upright retaining rods bilaterally projecting from the periphery of the reduced rear end; said upper shell comprises a front opening at a front end thereof which matches with the front opening of said bottom shell and receives said module plug therein, a longitudinal top opening extending to the front end which receives the springy rod of said module plug, two arched ribs bridging over said longitudinal top opening to protect the springy rod of said module plug in said longitudinal top opening, two downward hooks projecting from one side of said top shell opposite to said connecting strip and respectively hooked in the retaining notches of said bottom shell, a longitudinal wire groove defined within-a reduced rear end of said top shell and terminating in a rear opening for the passing of the electric wire of said module plug, and two retaining blocks bilaterally projecting from the periphery of the reduced rear end, each of said retaining blocks defining a retaining hole which receives one of said toothed upright retaining rods.

2. The connector jacket as claimed in claim 1 wherein each of said toothed upright retaining rods has a longitudinal series of teeth sloping in one direction; the retaining hole of each of said retaining blocks has a sloping side engaged with the teeth of the respective toothed upright retaining rod to prohibit it from backward movement.

* * * * *